United States Patent [19]

Tregoning

[11] 4,090,767

[45] May 23, 1978

[54] CABLE TERMINATION ASSEMBLY WITH CAST CONDUCTIVE SHIELD AND METHOD OF MAKING SAME

[76] Inventor: William Leonard Tregoning, 185 Quincy Shore Dr., North Quincy, Mass. 02171

[21] Appl. No.: 730,215

[22] Filed: Oct. 6, 1976

[51] Int. Cl.[2] ..... H01R 13/34; H01R 13/36; H01R 43/02; B22D 19/00

[52] U.S. Cl. ..... 339/143 R; 29/628; 164/98; 164/108; 174/35 C; 174/75 C; 339/275 R

[58] Field of Search ..... 174/35 C, 75 R, 75 C, 174/76, 78, 88 C; 29/628, 629; 228/179, 256, 257; 339/143 R, 275 R, 275 T; 164/47, 91, 98, 108, 110, 111, 112; 339/136 R, 136 C, 136 M, 177 R, 177 E, 195 M

[56] References Cited

U.S. PATENT DOCUMENTS

| | | | |
|---|---|---|---|
| 3,322,885 | 5/1967 | May et al. | 174/76 X |
| 3,496,634 | 2/1970 | Kurtz et al. | 164/98 X |
| 3,541,495 | 11/1970 | Ellis et al. | 174/75 C X |
| 3,744,128 | 7/1973 | Fisher et al. | 175/75 C X |

*Primary Examiner*—Laramie E. Askin
*Attorney, Agent, or Firm*—Russell & Nields

[57] ABSTRACT

The invention relates to shielded cables and in particular to an electrically conductive junction between the conduit which shields the cable and the electrical connector at the end of the cable which serves as the cable termination. In accordance with the invention this junction is molded directly onto the conduit and the electrical connector.

3 Claims, 6 Drawing Figures

CABLE TERMINATION ASSEMBLY WITH CAST CONDUCTIVE SHIELD AND METHOD OF MAKING SAME

BACKGROUND OF THE INVENTION

Cable assemblies having multiple conductors frequently are provided with RFI (radio frequency interference) shielding or EMI (electromagnetic interference) shielding, and this shielding may be a braided conduit or a flexible metal conduit. Such cable assemblies frequently are also subject to EMC (electromagnetic compatability) requirements. A typical braided conduit is tin over copper, in which wires or thin filaments of tin over copper are braided to form the conduit. Another typical material is stainless steel. The electrical connector termination typically has a plurality of apertures to receive each wire in the cable assembly. Moreover, in order to make the connection between the individual wire and the aperture therefor, provision must be made which tends to occupy additional space, sometimes involving jumper connections. The electrical connector termination thus has an outside diameter which is substantially greater than that of the cable. These cables are useful in the aerospace commercial program and elsewhere.

In the present art one method of connecting the braided shielding of the cable assembly to the electrical connector is as follows. An additional length of braided conduit is fitted in part snugly over one end of the connector and also partly placed in contact with the regular braided conduit and soldering connections are made. Measurements of connections such as these have indicated resistance as high as 24 ohms. Thus the connection is unsatisfactory and it is also somewhat cumbersome to apply.

A second technique is the use of a back shell adaptor which involves a substantial length of rigid metal-like material, one end of which is provided with means to grasp the braided conduit and the other end of which screws over the electrical connector. This provides highly efficient shielding but the shielding costs are relatively high. Furthermore, dimensional requirements are severe in that the outer diameter of the back shell cannot exceed the outer diameter of the connector, and this requirement frequently leaves insufficient room inside the back shell.

SUMMARY OF THE INVENTION

In accordance with the invention I mold a conductive connection directly onto the electrical connector and braided conduit shielding the cable assembly. As a simple connection I may pre-tin the connector, surround the pertinent area with an aluminum mold, and pour in solder comprising 60% tin and 40% lead. This has given a satisfactory connection. My invention also includes other molding techniques such as injection molding. I also may use transfer molding particularly when using such materials as conductive epoxies. However, I may use any conducting material or alloy. As a final step, an insulator of polyurethane, neoprene rubber, or other insulating material may be molded over the metal, but such polyurethane molding is well known in the art and does not form a part of the present invention. The thickness of this insulator might be, for example, 1/16 of an inch.

My invention also includes single conductor co-axial cable which is shielded.

My invention is not limited to any particular shape of molded connection.

DETAILED DESCRIPTION OF A PREFERRED EMBODIMENT

The invention may best be understood from the following detailed description thereof, having reference to the accompanying drawings in which.

Figure 1:
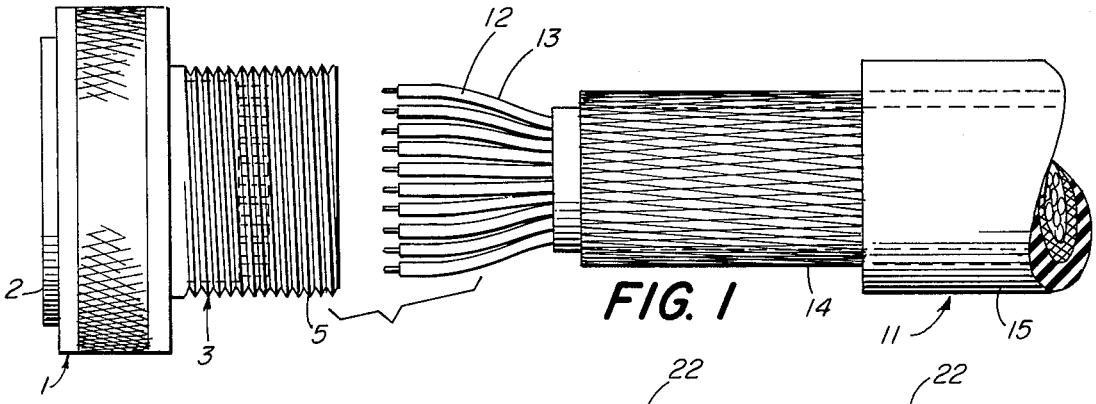
FIG. 1 is a side view of a multi-conductor cable and a connector plug to which the end of the cable is to be joined.
Figure 1A:
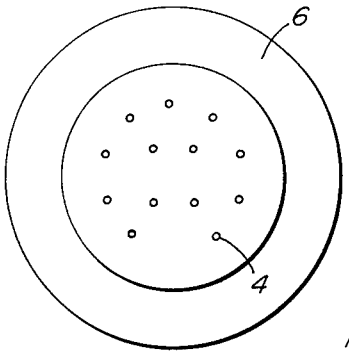
FIG. 1A is an end view of the connector plug of FIG. 1.

Referring to the drawings and first to FIG. 1 thereof, therein is shown a connector plug 1 into which the ends of the conductors of the multi-conductor cable are to be fitted. The connector plug includes a face section 2 which is adapted to be connected to another connector plug, or a termination on a chassis, or any other suitable connection. The connector plug 1 also includes a back section 3 having a plurality of apertures 4 adapted to receive the conductors of the multi-conductor cable. The apertures 4 are shown in FIG. 1A. The back section 3 of the connector 1 is threaded in the conventional way, since such connector plugs are of standard design and are adapted to be screwed into back shells which are also available on the market. In accordance with the invention, the threads 5 on the back section 3 are used to provide firm engagement with the molded shield, to be described hereinafter.

In accordance with conventional cable techniques, the cable 11 contains a multiplicity of conductors 12 each of which has its own insulation 13. Each conductor 12 is adapted to be inserted into a corresponding aperture 4 in the connector plug 1. For uses which require shielding against radio frequency interference and electromagnetic interference, these insulated conductors 12 must be wrapped in a suitable shield of conducting material. Such a shield is shown at 14 and conventionally comprises a multiplicity of fine wires which are braided or otherwise formed into a suitable conductive covering for the cable. Surrounding the shield 14 is an overall cable jacket 15 of insulating material.

Figure 4:
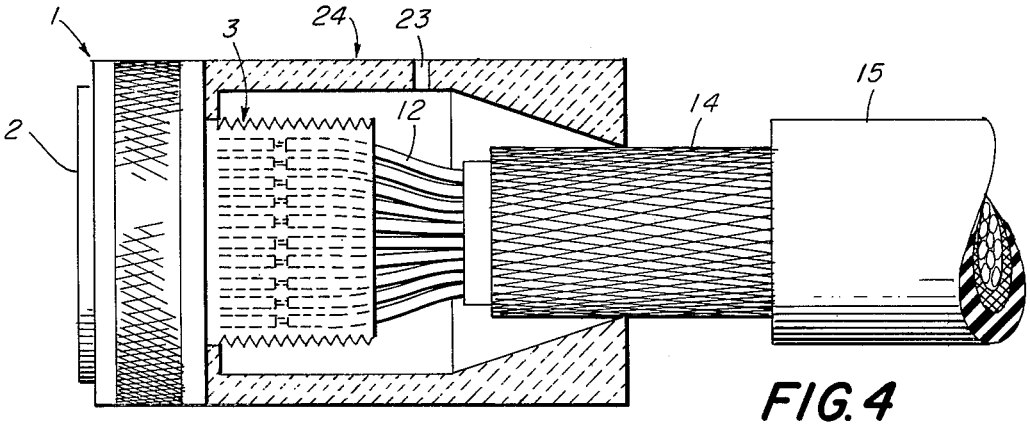
FIG. 4 is a view similar to that of FIG. 1 showing the second step in carrying out the method of the invention.
Figure 5:
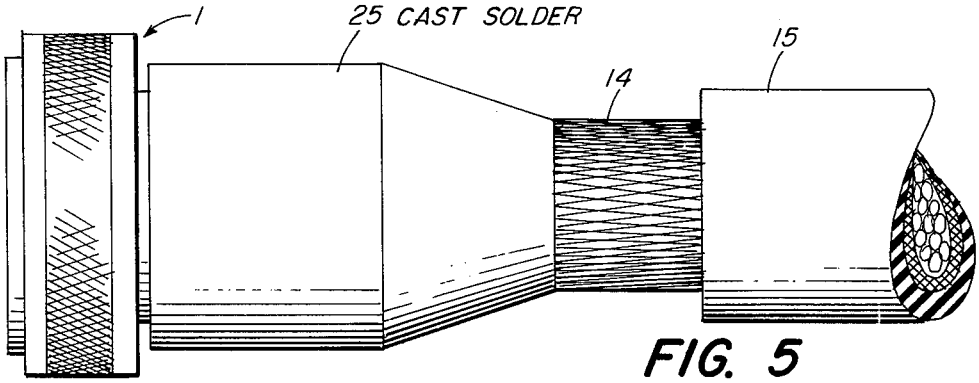
FIG. 5 is a side view similar to that of FIG. 1 showing the connector plug attached to the multi-conductor cable in accordance with the invention.

In order to connect the conductors 12 of the cable to the connector plug 1, each conductor 12 is inserted into an electrically conductive tube in a corresponding aperture 4 by techniques which are well known in the art. When connected, the cable and connector plug assembly appears as shown in FIG. 4. The overall cable jacket 15 has been removed for a certain length from the end of the cable so as to expose the overall cable shield 14. The overall cable shield 14 in turn has been removed at the extremity of the cable so as to expose the insulated conductors 12 to permit handling thereof and insertion into the aperture 4 in the connector plug 1. In order to provide adequate shielding against radio frequency interference and electromagnetic interference, it is necessary in an electrical sense to provide shielding between the connector plug 1 and the overall cable shield 14. The connector plug 1 includes its own electrical shield 6 which extends back and includes the back section 3. Prior art attempts to provide this connecting shield have included the provision of an auxiliary braided shield between the threaded back section 3 and the overall cable shield 14. Such an auxiliary shield is extended over the threaded back section 3 and over the overall cable shield 14 and soldered at each extremity. Another prior art device includes a tubular metal shield which is internally threaded so as to engage the threads 5 on the back section of the connector, this cylindrical shield being long enough so as to extend to the end of the overall cable shield 14 to which it is clamped.

Figure 2:
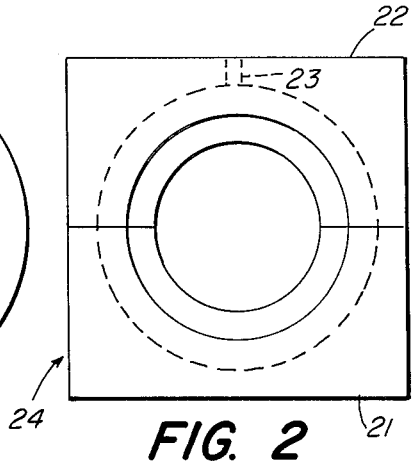
FIG. 2 is an end view of a mold for use in practicing the method of the invention.
Figure 3:
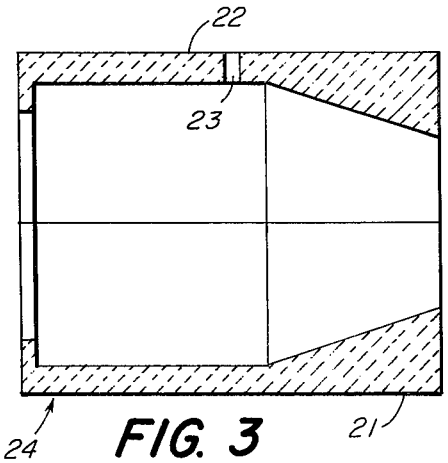
FIG. 3 is a longitudinal section of the mold of FIG. 2.

In accordance with the invention I make use of a suitable mold such as that shown in FIGS. 2 and 3. Such a mold may comprise suitable refractory material in two semi-cylindrical parts 21 and 22. The upper part 22 has an aperture 23 adapted to receive the molten metallic or other conductive material. The mold 24 is positioned as shown in FIG. 4 so as completely to surround the extremity of the back section 3, the extremity of the overall cable shield 14, and the intervening gap. The inside diameter of the mold is chosen so as to be only slightly greater than the outside diameter of the back section 3. The mold is assembled as shown in FIG. 4 after the conductors 12 have been connected to the apertures 4 and after suitable potting compound has been packed around the insulated conductors 12. After the mold is assembled, suitable molten metal or other conductive material is poured in through the aperture 23 so as to fill the mold. After cooling, the mold is removed thereby leaving a molded shield 25 which is rigid and firmly affixed to the threads 5 on the back section 3. The interstices among the braids of the cable shield 14 and on the outer surface of the conductors 12 with their associated potting compound insure firm engagement of the metal of the molded shield with the underlying surfaces.

The invention provides a positive breakthrough to offer cable users many advantages unobtainable with existing cable assemblies. Among these advantages are the following:

Direct metal one step conductive 360° contact from shield of cable directly to the rear of connector plug;

Adds rigid, low profile support and strain relief to terminated wires at rear of connectors;

Eliminates bulky multi-part RFI-EMI back shells, cable clamps, and uses of conductive epoxys;

RFI-EMI techniques of the invention can be applied to most connector types.

The invention makes it possible to have low conductive path throughout the entire cable assembly, with the technique of metal to metal contact of the invention, which allows a low RF impedance to be achieved which results in a high shield effectiveness or high attenuation.

Having thus described the principles of the invention together with illustrative embodiments thereof, it is to be understood that although specific terms are employed, they are used in a generic and descriptive sense and not for purposes of limitation, the scope of the invention being set forth in the following claims.

I claim:

1. That method of manufacturing a cable termination for a cable having a first shield and having a number of conductors, which number is at least one which method comprises connecting said number of conductors to a connector plug having a second shield so as to form a cable-plug assembly, placing said assembly in a mold which extends over both shields, filling said mold with cast metallic conductive material, and removing said mold.

2. A termination assembly for a cable comprising, in combination with a cable having an overall cable shield and having a number of conductors, which number is at least one, a connector plug havng a shield and being connected to said number of conductors of said cable so that said shield is longitudinally spaced from said overall cable shield by an intershield gap, and cast metallic rigid conductive material engaging both of said shields and surrounding and filling the intershield gap.

3. A termination assembly in accordance with claim 2 wherein said cable is a multi-conductor cable.

* * * * *